US007631589B2

(12) United States Patent
Hunn et al.

(10) Patent No.: US 7,631,589 B2
(45) Date of Patent: Dec. 15, 2009

(54) APPARATUS FOR INHIBITING EFFECTS OF AN EXPLOSIVE BLAST

(75) Inventors: David L. Hunn, Kennedale, TX (US); Sang J. Lee, Coppell, TX (US); James C. Copp, Arlington, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 448 days.

(21) Appl. No.: 11/414,843

(22) Filed: May 1, 2006

(65) Prior Publication Data

US 2009/0272254 A1 Nov. 5, 2009

Related U.S. Application Data

(63) Continuation-in-part of application No. 11/371,703, filed on Mar. 9, 2006.

(51) Int. Cl.
*F41H 5/02* (2006.01)

(52) U.S. Cl. ..... 89/36.02

(58) Field of Classification Search ..... 89/36.02
See application file for complete search history.

(56) References Cited

U.S. PATENT DOCUMENTS 2,360,525 A * 10/1944 Sperry ..... 220/653
6,630,249 B2 * 10/2003 Kennedy ..... 428/625

* cited by examiner

*Primary Examiner*—Stephen M Johnson
(74) *Attorney, Agent, or Firm*—Daren C. Davis; James E. Walton

(57) ABSTRACT

An apparatus for inhibiting effects of an explosive blast includes a central portion including a stiffening element and defining a radiused exterior surface and a plurality of sides extending from the central portion for attachment to a structure. The central portion and the plurality of sides are configured to redirect at least a portion of a blast wave resulting from an explosive blast. A vehicle hull includes a personnel compartment and an apparatus for inhibiting effects of an explosive blast operably associated with the personnel compartment. The apparatus includes a central portion including a stiffening element and defining a radiused exterior surface and a plurality of sides extending between the central portion and the personnel compartment. The central portion and the plurality of sides are configured to redirect at least a portion of a blast wave resulting from an explosive blast.

27 Claims, 7 Drawing Sheets

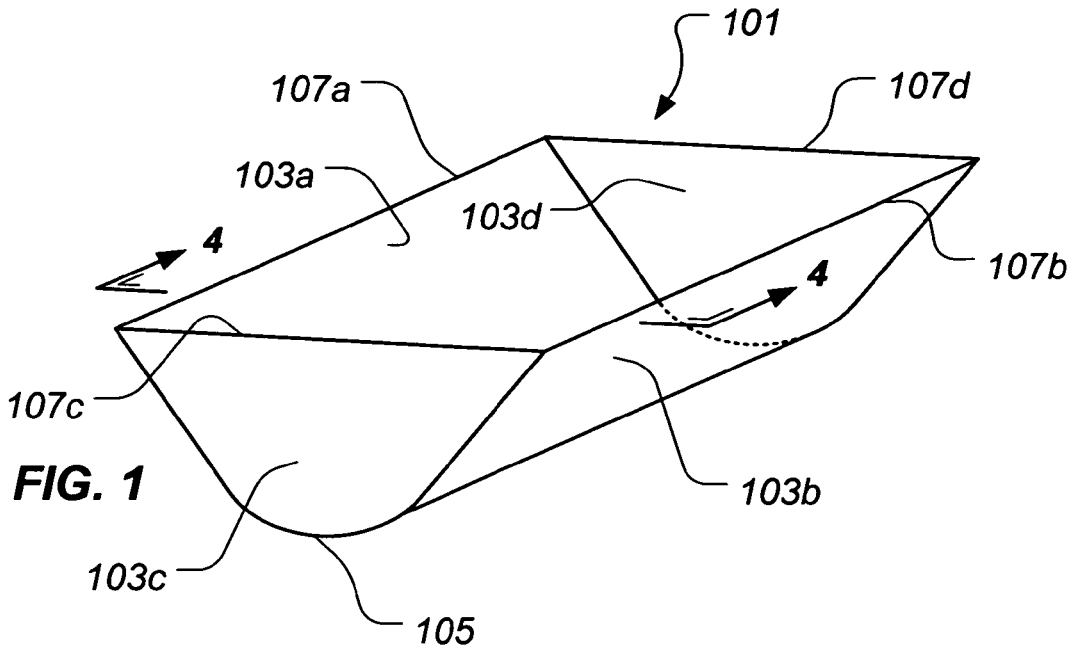
FIG. 1
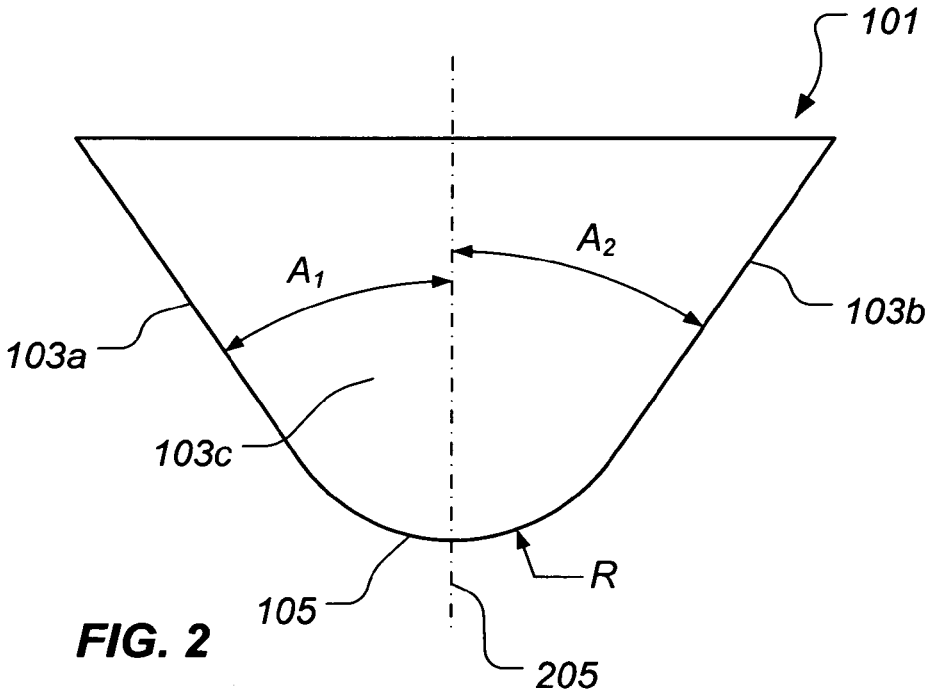
FIG. 2
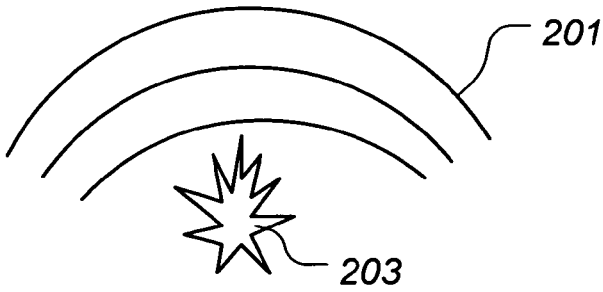

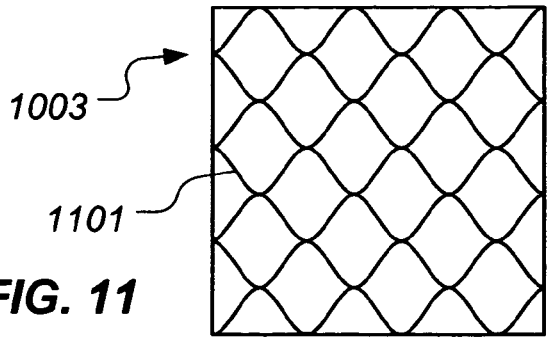
FIG. 11
FIG. 12
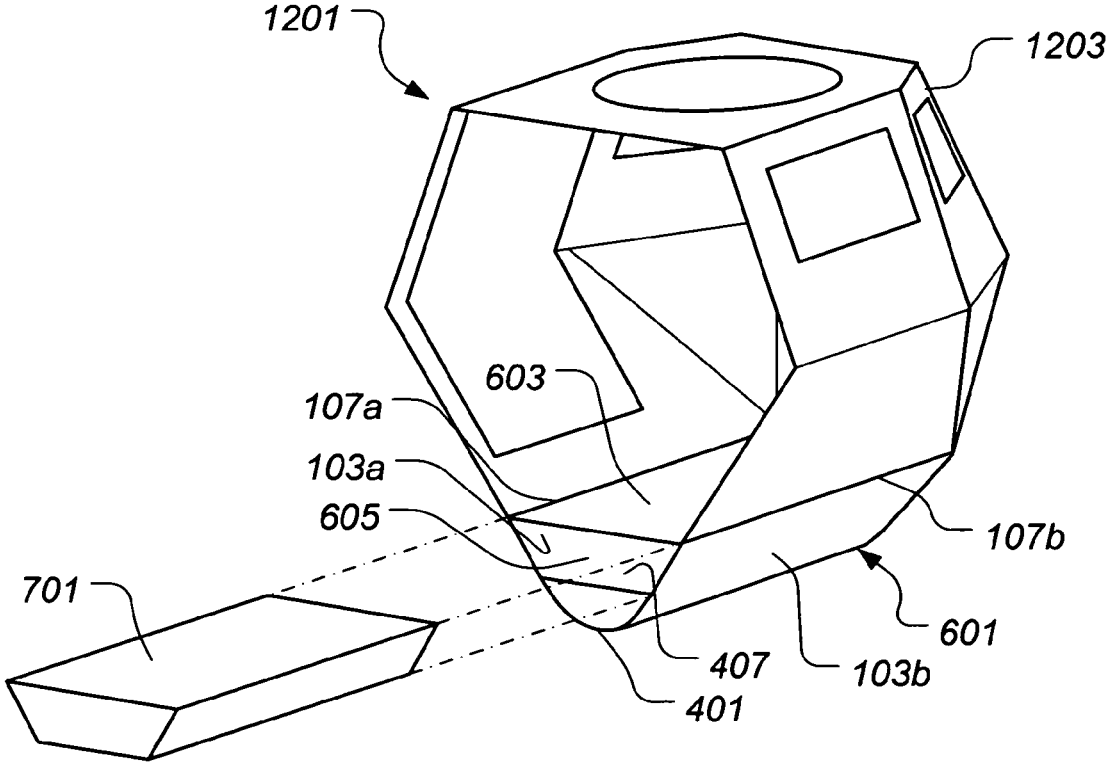

APPARATUS FOR INHIBITING EFFECTS OF AN EXPLOSIVE BLAST

CROSS-REFERENCE TO RELATED APPLICATIONS

This application is a continuation-in-part of commonly-owned, co-pending U.S. patent application Ser. No. 11/371,703, entitled "Blast Attenuator and Method of Making Same," by inventor David L. Hunn, filed on 9 Mar. 2006, which is incorporated herein by referenced for all purposes.

BACKGROUND

1. Field of the Invention

The present invention relates to explosive blast protection devices for vehicles.

2. Description of Related Art

Modern combat theaters require new operational doctrines to counter unsymmetrical and unpredictable threats. Vehicles, such as tanks, personnel carriers, trucks, and the like, operating in such theaters must be light, agile, and maneuverable while protecting personnel in the vehicles from the deleterious effects of explosive blasts. Mines and improvised explosive devices pose significant threats to vehicles, and particularly to light vehicles, in today's combat theaters. The explosive characteristics of mines and improvised explosive devices varies widely, ranging from relatively small devices to large, wired bombs and artillery shells.

Conventional vehicles that have been designed to mitigate the effects of such explosive devices are large and heavy, often weighing more than 5400 kg (6 tons). Such vehicles have limited tactical utility and transportability because of their extreme weight.

There are many vehicles configured to withstand explosive blasts that are well known in the art, however, considerable shortcomings remain.

SUMMARY OF THE INVENTION

There is a need for an improved apparatus for inhibiting effects of an explosive blast.

Therefore, it is an object of the present invention to provide an improved apparatus for inhibiting effects of an explosive blast.

These and other objects are achieved by providing an apparatus for inhibiting effects of an explosive blast. The apparatus includes a central portion including a stiffening element and defining a radiused exterior surface and a plurality of sides extending from the central portion for attachment to a structure. The central portion and the plurality of sides are configured to redirect at least a portion of a blast wave resulting from an explosive blast.

In another aspect, the present invention provides an apparatus for inhibiting effects of an explosive blast. The apparatus includes a central portion having an outer skin exhibiting a radius, an inner skin, and a stiffening element extending between the outer skin and the inner skin. The apparatus further includes a plurality of sides extending from the outer skin of the central portion, a first transverse member extending between the plurality of sides, and a second transverse member extending between the plurality of sides, such that the first transverse member, the second transverse member, and the plurality of sides define a cavity. The apparatus further includes a blast attenuator disposed in the cavity. The blast attenuator includes a core defining a plurality of interconnecting pores defining a pore volume of the core, a shear thickening fluid disposed in the pore volume of the core, and an enclosure in which the core and the shear thickening fluid are disposed.

In yet another aspect of the present invention, a vehicle hull is provided. The vehicle hull includes a personnel compartment and an apparatus for inhibiting effects of an explosive blast operably associated with the personnel compartment. The apparatus includes a central portion including a stiffening element and defining a radiused exterior surface and a plurality of sides extending between the central portion and the personnel compartment. The central portion and the plurality of sides are configured to redirect at least a portion of a blast wave resulting from an explosive blast.

The present invention provides significant advantages, including: (1) providing lighter weight means for protecting personnel and equipment from the deleterious effects of explosive blasts; (2) providing lower cost means for protecting personnel and equipment from the deleterious effects of explosive blasts; and (3) providing means to retrofit existing vehicles and other such structures with means for inhibiting effects of explosive blasts.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

FIG. 1 is a perspective view of a first illustrative embodiment of an apparatus according to the present invention for inhibiting effects of an explosive blast;

FIG. 2 is an end view of the apparatus of FIG. 1;

FIG. 11 is a cross-sectional view of the crushable element of FIG. 10B, taken along the line 11-11 in FIG. 10B;

FIG. 12 is a partially exploded, perspective view of a first illustrative embodiment of a vehicle hull according to the present invention;

Figure 3:
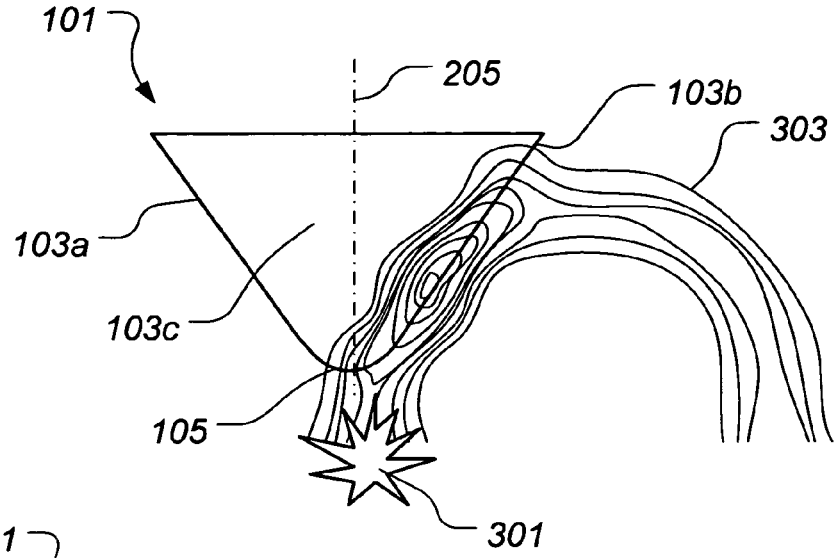
FIG. 3 is a stylized view of a simulation of the explosive blast pressure resulting from the detonation of an explosive blast proximate an apparatus according to the present invention for inhibiting effects of an explosive blast.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an apparatus for inhibiting the deleterious effects of explosive devices, such as mines, improvised explosive devices, and the like. The apparatus is particularly suited for use with a vehicle, such as a jeep, a personnel carrier, a truck, or the like, but may be used with other structures. In one embodiment, the apparatus is appended to an existing vehicle or other structure. In another embodiment, the apparatus is incorporated into a vehicle or other structure. Generally, the apparatus includes a plurality of sides, upwardly extending from a radiused, central portion. The central portion includes a stiffening element. The central portion and the plurality of sides are configured to deflect at least a portion of a blast wave generated when an explosive device proximate the apparatus is initiated (i.e., detonated or deflagrated). The central portion is crushed to some degree but withstands the intensity of forces imparted on the apparatus by the blast wave. In one embodiment, the apparatus further includes a blast attenuator, such as one of the embodiments of the blast attenuator disclosed in commonly-owned, co-pending U.S. patent application Ser. No. 11/371,703, entitled "Blast Attenuator and Method of Making Same," by inventor David L. Hunn, filed on 9 Mar. 2006.

FIG. 1 depicts a perspective view of a first illustrative embodiment of an apparatus 101 according to the present invention for inhibiting the deleterious effects of an explosive blast. Apparatus 101 comprises a plurality of sides 103*a*-103*d* extending from a radiused, central portion 105, forming a partially hollow structure. Apparatus 101 may exhibit various configurations along edges 107*a*-107*d* for attachment to a vehicle (not shown in FIG. 1) or other such structure. Alternatively, apparatus 101 may be incorporated into a hull of a vehicle, as will be discussed in greater detail below. Generally, central portion 105 exhibits a partial cylindrical shape or a partial frustoconical shape.

Apparatus 101 comprises a material having a modulus of elasticity greater than about ten million pounds per square inch. Preferably, apparatus 101 comprises a metallic material and, more preferably, apparatus 101 comprises aluminum, aluminum alloyed with one or more elements, titanium, titanium alloyed with one or more elements, or steel.

FIG. 2 depicts an end, elevational view of apparatus 101. Preferably, apparatus 101 is oriented in use such that a blast wave 201 resulting from the initiation of an explosive device (represented by graphic 203) will encounter central portion 105 prior to encountering a vehicle or other such structure to which apparatus 101 is attached or into which apparatus 101 is incorporated. In a preferred embodiment, central portion 105 exhibits a radius R of at least about 15 centimeters and sides 103*a*, 103*b* outwardly extend from central portion 105 at angles $A_1$, $A_2$ within a range of about 25 degrees to about 60 degrees from a central axis 205 that bisects central portion 105.

Irrespective of the particular configuration, sides 103*a*, 103*b* and central portion 105 (and, thus, apparatus 101) are configured to deflect at least a portion of the energy of a blast wave (e.g., blast wave 201) generated by the initiation of an explosive device, such as a mine or an improvised explosive device. FIG. 3 provides a stylized view of a finite element model simulation of the explosive blast pressure resulting from the detonation (represented by a graphic 301) of a four kilogram charge of 2,4,6-trinitrotoluene (TNT) below apparatus 101 and offset slightly from central axis 205 of apparatus 101. The simulation illustrates that a portion of the blast pressure (e.g., at 303) is deflected away from apparatus 101 by side 103*b*.

Figure 4:
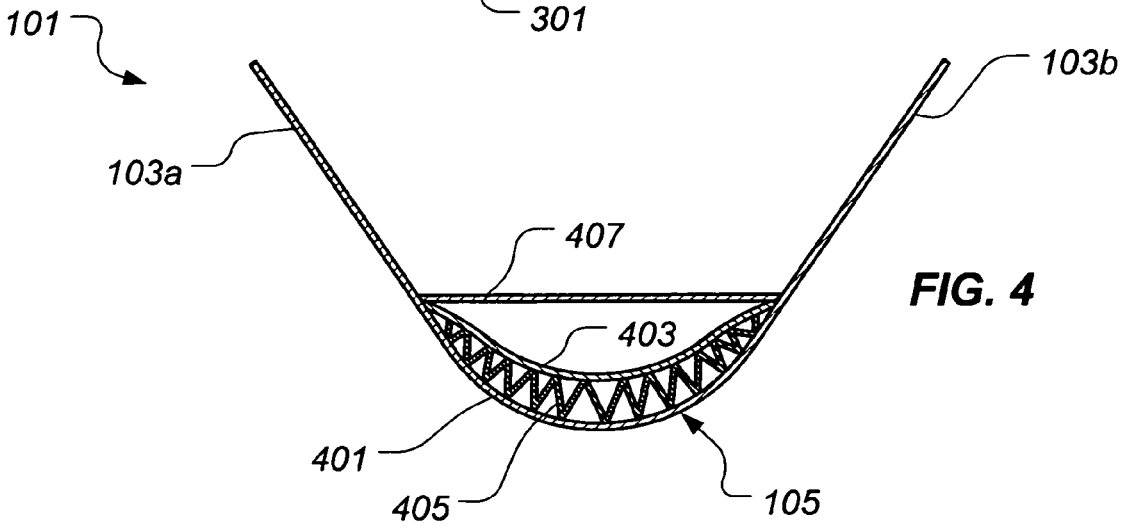
FIG. 4 is a cross-sectional view of the apparatus of FIG. 1 taken along the line 4-4 in FIG. 1.

FIG. 4 depicts a cross-sectional view of apparatus 101 taken along the line 4-4 in FIG. 1. Central portion 105 comprises an outer skin 401, an inner skin 403, and one or more stiffening elements 405 extending between outer skin 401 and inner skin 403. Preferably, the one or more stiffening elements 405 form a truss. The illustrated embodiment includes a single stiffening element 405 taking on a truss form. In one embodiment, sides 103*a*, 103*b* and central portion 105 are formed using three-sheet superplastic forming techniques, as will be discussed in greater detail below. Preferably, apparatus 101 further includes a first transverse member 407 extending between sides 103*a*, 103*b*. First transverse member 407 provides additional stiffness to apparatus 101.

Figure 5:
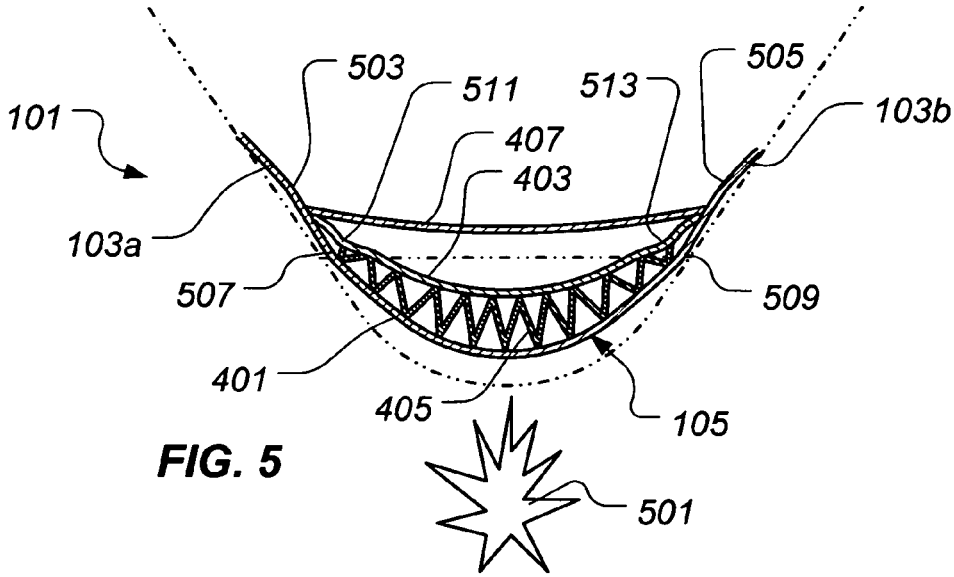
FIG. 5 is a stylized view of a simulation of the deformation of an apparatus according to the present invention for inhibiting effects of an explosive blast resulting from being subjected to an explosive blast.

FIG. 5 depicts a stylized view of a finite element model simulation of the deformation of apparatus 101 resulting from being subjected to an explosive blast generated by the detonation (represented by a graphic 501) of a four kilogram charge of TNT below apparatus 101. An outline of apparatus 101 prior to the simulated detonation is shown in phantom. The anticipated configuration of a portion of apparatus 101, after being subjected to the explosive blast, is shown in cross-section. As can be seen, while apparatus 101 has sustained some buckling and crushing, apparatus 101 remains intact. Specifically, sides 103*a* and 103*b* are buckled, for example, at 503 and 505, respectively. Outer skin 401 of central portion 105 is buckled, for example, at 507 and 509. Inner skin 403 of central portion 105 is buckled, for example, at 511 and 513. Stiffening element 405 is correspondingly deformed. Moreover, first transverse member 407 is buckled toward outer skin 401 of central portion 105. The remaining portions of apparatus 101 remain substantially undeformed. It should be noted that blast waves having other intensities and/or propagating from other directions will deform apparatus 101 in other ways. For example, central portion 105 may be completely crushed when subjected to forces resulting from an explosive blast.

Figure 6:
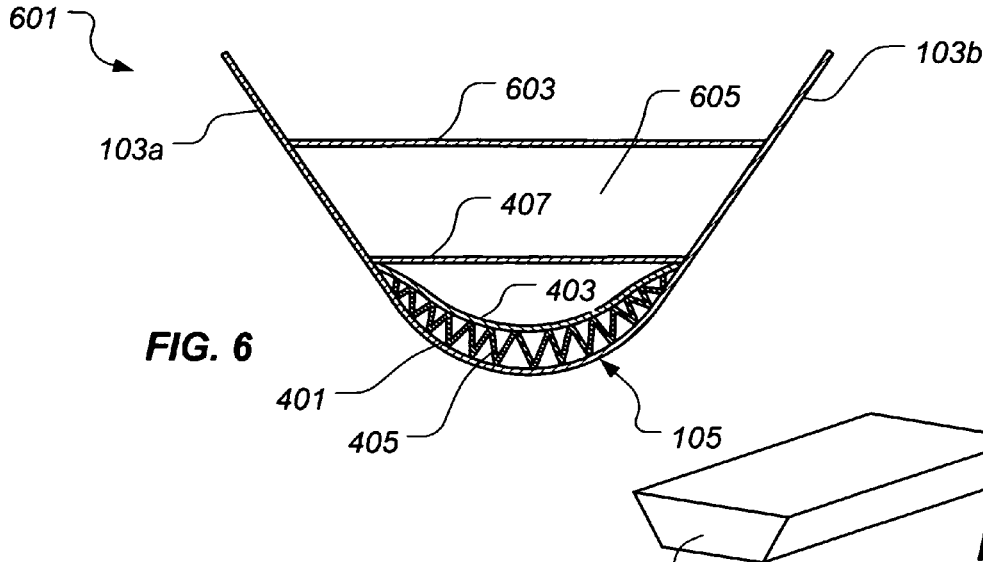
FIG. 6 is a cross-sectional view, corresponding to the view of FIG. 4, of a second illustrative embodiment of an apparatus according to the present invention for inhibiting effects of an explosive blast.

FIG. 6 depicts a cross-sectional view, corresponding to the view of FIG. 4, of a second illustrative embodiment of an apparatus 601 according to the present invention for inhibiting the deleterious effects of explosive devices. Apparatus 601 corresponds to apparatus 101 except that apparatus 601 comprises a second transverse member 603 extending between sides 103*a*, 103*b*. Sides 103*a*-103*d* and transverse members 407, 603 define a cavity 605. Note that sides 103*c* and 103*d* are shown in FIG. 1.

Figure 7:
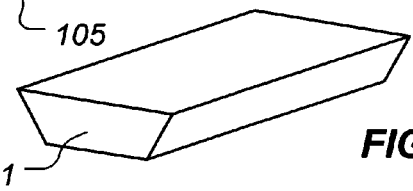
FIG. 7 is a perspective view of a blast attenuator according to the present invention.
Figure 8:
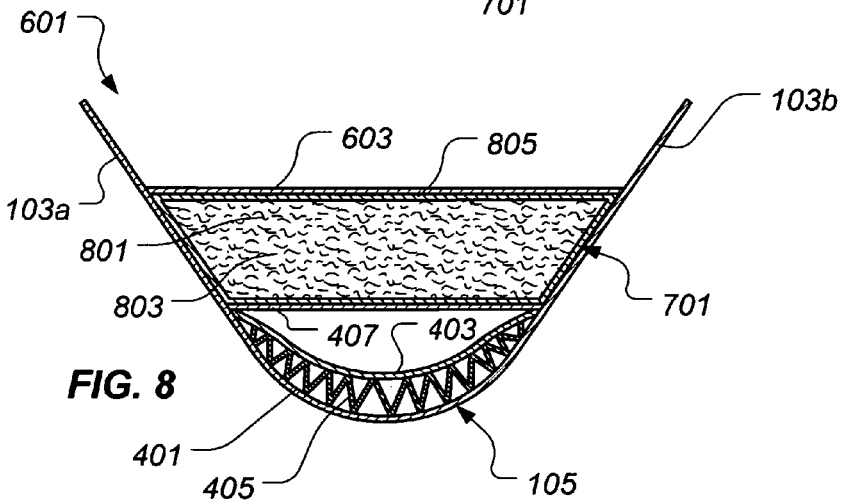
FIG. 8 is a cross-sectional view, corresponding to the view of FIG. 4, of the apparatus of FIG. 6 including the blast attenuator of FIG. 7.

Cavity 605 is configured to receive a blast attenuator 701, shown in FIG. 7. FIG. 8 depicts a cross-sectional view, corresponding to the view of FIG. 4, of apparatus 601 with blast attenuator 701 disposed in cavity 605. In a first illustrative embodiment, blast attenuator 701 includes a core 801 comprising a plurality of interconnected pores. Preferably, core 801 comprises a metallic sponge or foam. A shear thickening fluid 803 fills at least a portion of the pore volume of core 801. Core 801 and shear thickening fluid 803 are contained within an enclosure 805.

Figure 9:
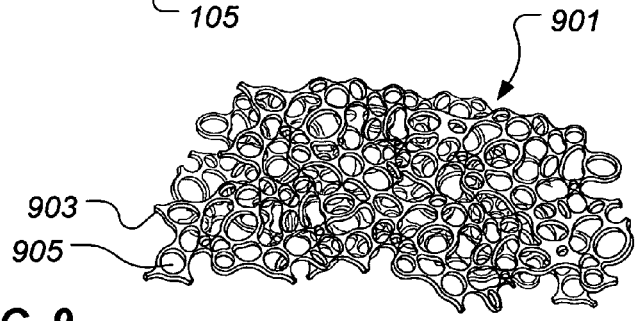
FIG. 9 is a perspective view of an exemplary metallic foam of one particular embodiment of the blast attenuator of FIG. 7.

Preferably, core 801 comprises an open-celled foam. More preferably, core 801 comprises an open-celled metallic foam, such as an exemplary metallic foam 901 of FIG. 9. The metallic foam may comprise aluminum, aluminum alloyed with one or more other elements, titanium, titanium alloyed with one or more other elements, stainless or other corrosion-resistant steel, or the like. Other materials may be employed in core 801, so long as core 801 exhibits a compressive strength of at least about 400 kilopascals and a density of at least about 120 kilograms per cubic meter.

Core 801 comprises a structural network defining a plurality of interconnected pores. Such a configuration is exemplified in metallic foam 901 of FIG. 9. Metallic foam 901 comprises, in this particular embodiment, a structural network 903 defining a plurality of interconnected pores 905 (only one labeled for clarity). In other words, some, and in some instances all, of the plurality of pores 905 are in fluid communication with one another. As such, a fluid may flow from one pore 905 to an adjacent pore 905, and so on.

A pore volume of core 801 corresponds to the individual volumes of the plurality of pores 905, in the aggregate, bounded by enclosure 805. In other words, the pore volume of core 801 corresponds to the volume of enclosure 805 less the volume of structural network 903. According to the present invention, shear thickening fluid 803 fills at least a portion of the pore volume of core 801 and is retained within the pores, such as pores 905, by enclosure 805. Preferably, shear thickening fluid 803 fills a majority of the pore volume of core 801 and, more preferably, shear thickening fluid 803 fills substantially all of the pore volume of core 801.

Generally, shear thickening or dilatant fluids are non-Newtonian fluids that exhibit increasing viscosities with increasing shear rates. For example, a shear thickening fluid, when manipulated at a low shear rate, exhibits low viscosity and acts as a liquid. When manipulated at a high shear rate, however, the shear thickening fluid exhibits high viscosity and acts more like a solid. Shear thickening fluids exhibit no appreciable yield stress.

Examples of shear thickening fluids (e.g., shear thickening fluid 803) include, but are not limited to, dispersions of cornstarch in water, dispersions of silica in ethylene glycol, dispersions of certain clays in water, dispersions of titanium dioxide in water, and dispersions of silica in water. Preferably, shear thickening fluid 803 comprises silica particles dispersed in ethylene glycol. More preferably, the silica particles exhibit diameters of at least 200 nanometers. Moreover, it is preferable for shear thickening fluid 107 to exhibit a volume fraction of silica particles of at least about 0.4. The composition of shear thickening fluid 803 employed in blast attenuator 701 is implementation specific, depending at least upon the velocity, intensity, etc. of the explosive blast wave that blast attenuator 701 is expected to encounter. It should be noted that blast attenuator 701 may comprise any suitable shear thickening fluid 803.

Generally, an explosive blast wave (e.g., blast wave 201 of FIG. 2) imparts an impact force to apparatus 101 and, thus, to blast attenuator 701. The impact force compresses blast attenuator 701 and, as blast attenuator 701 is compressed, shear thickening fluid 803 is subjected to high rates of shear. Accordingly, shear thickening fluid 803 exhibits an increased viscosity and, preferably, becomes at least semi-rigid while shear thickening fluid 803 is subjected to high shear rates, at least partially attenuating the energy of the impact force. As the intensity of the impact force subsides, shear thickening fluid 803 is subjected to lower and lower rates of shear. Accordingly, shear thickening fluid 803 exhibits decreasing viscosities corresponding to the lower rates of shear. If the impact force is sufficient in duration after subsiding in intensity, such that shear thickening fluid 803 behaves as a liquid, blast attenuator 701 is further compressed. Depending upon the intensity of the impact force, enclosure 805 is ruptured and shear thickening fluid 803 flows from within enclosure 805 through the rupture. It should be noted that, depending upon the magnitude and orientation of the impact force, enclosure 805 will rupture prior to shear thickening fluid 803 again behaving as a liquid.

Figure 10A:
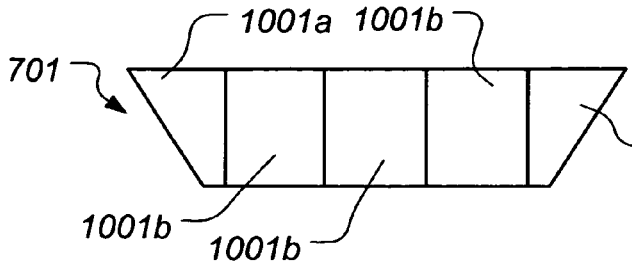
FIGS. 10A-10E are end, elevational views of various, alternative illustrative embodiments of the blast attenuator of FIG. 7.

FIGS. 10A-10E and 11 depict various alternative, illustrative embodiments of blast attenuator 701. It should be noted, however, that the scope of the present invention is not limited to the particular embodiments disclosed herein and depicted in the drawings. FIG. 10A depicts a second illustrative embodiment of blast attenuator 701. In the illustrated embodiment, blast attenuator 701 comprises a plurality of blast attenuation components 1001*a*-1001*c*, arranged adjacent to one another. In the illustrated embodiment, each of the plurality of blast attenuation components 1001*a*-1001*c* have a configuration corresponding to the embodiment of FIG. 8. In other words, each of the plurality of blast attenuation components 1001*a*-1001*c* includes a core comprising a structural network defining a plurality of interconnected pores. The core is disposed in an enclosure. A shear thickening fluid fills at least a portion of the pore volume of the core.

Figure 10B:
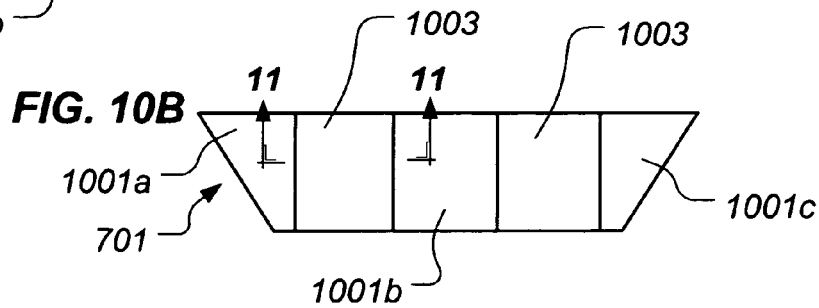

FIG. 10B depicts a third illustrative embodiment of blast attenuator 701. Generally, in this particular embodiment, blast attenuator 701 comprises at least one blast attenuation component (e.g., blast attenuation components 1001*a*-1001*c*) disposed adjacent a crushable element 1003. Crushable element 1003, however, omits shear thickening fluid 803. In the embodiment of FIG. 10B, a plurality of blast attenuation components 1001*a*-1001*c* are interposed with a plurality of crushable elements 1003. Blast attenuation components 1001*a*-1001*c* and crushable elements 1003 attenuate impact forces resulting from explosive blasts. However, as discussed above, blast attenuation components 1001*a*-1001*c* attenuate the impact forces to a greater degree than crushable elements 1003, because of shear thickening fluid 803. Crushable elements 1003 comprise, in various embodiments, honeycomb, open-celled foam, closed-cell foam, and/or corrugations. One example of such a corrugation is a corrugated web 1101 (only one indicated for clarity), shown in FIG. 11.

Figure 10C:
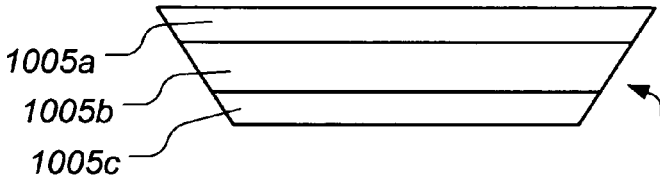

FIG. 10C depicts a fourth illustrative embodiment of blast attenuator 701 according to the present invention. In the illustrated embodiment, blast attenuator 701 comprises a plurality of layers 1005*a*-1005*c*. Layers 1005*a*-1005*c* include any combination of blast attenuation components (e.g., blast attenuation components 1001*a*-1001*c*) comprising a shear thickening fluid and crushable elements (e.g. crushable element 1003), which omits a shear thickening fluid.

Figure 10D:
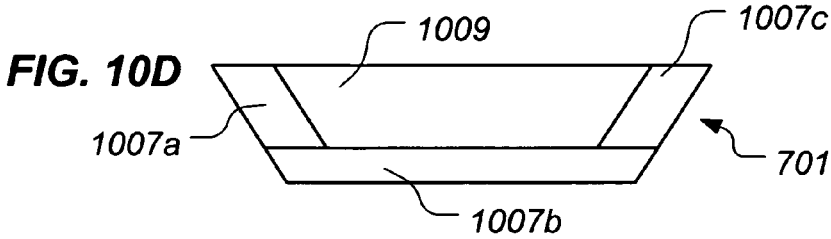

FIG. 10D depicts a fifth illustrative embodiment of blast attenuator 701 according to the present invention. In this embodiment, blast attenuation components 1007*a*-1007*c* are arranged adjacent a crushable element 1009. The particular construction of blast attenuation components 1007*a*-1007*c* and crushable element 1009, in one embodiment, correspond to the constructions discussed above relating to blast attenuation components 1001*a*-1001*c* and crushable element 1003, respectively. Blast attenuation components 1007*a*-1007*c* are arranged such that forces resulting from an explosive blast encounter blast attenuation components 1007*a*-1007*c* before encountering crushable element 1009. In this way, a greater amount of the forces are attenuated by blast attenuation components 1007*a*-1007*c* prior to the remaining forces encountering crushable element 1009.

Figure 10E:
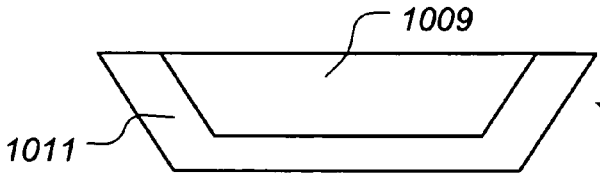

It should be noted, however, that blast attenuation components 1007*a*-1007*c* may be combined into a single blast attenuation component 1011, as illustrated in FIG. 10E. Moreover, blast attenuation components (e.g., blast attenuation components 1007*a*-1007*c*) of the present invention may have any desired geometric configuration, such that, in this embodiment, forces resulting from an explosive blast encounter the blast attenuation components before encountering crushable element 1009.

FIG. 12 depicts one particular embodiment of a vehicle hull 1201 according to the present invention. Hull 1201 includes a personnel compartment 1203 and apparatus 601 for inhibiting effects of an explosive blast. In one embodiment, blast attenuator 701 is disposed in cavity 605. Blast attenuator 701 may comprise any of the embodiments disclosed herein and shown in the drawings or any other suitable configuration, so long as at least one portion of blast attenuator comprises a core defining a plurality of interconnected pores and a shear thickening fluid. In one embodiment, blast attenuator 701 is omitted. Alternatively, hull 1201 may comprise apparatus 101 for inhibiting effects of an explosive blast, as best illustrated in FIG. 4. Note that, in the illustrated embodiment, edges 107*a*, 107*b* extend substantially a full width of personnel compartment 1203 where apparatus 601 meets personnel compartment 1203. Preferably, personnel compartment 1203 is configured, as shown in FIG. 12, to further deflect a blast wave resulting from an explosive blast.

Figure 13:
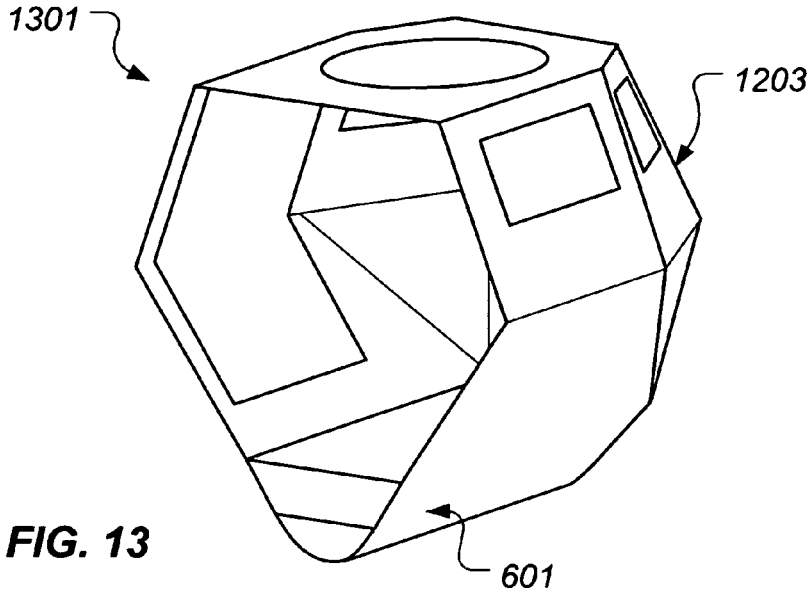
FIG. 13 is a perspective view of a second illustrative embodiment of a vehicle hull according to the present invention.

In the embodiment of FIG. 12, apparatus 601 is attached to personnel compartment 1203 to form vehicle hull 1201. Alternatively, as depicted in FIG. 13, apparatus 601 and personnel compartment 1203 may be incorporated into a unitary structure, taking on the form of vehicle hull 1301.

It will be appreciated that apparatus 101 or 601, or other embodiments within the scope of the present invention, may be configured as an add-on kit for an existing vehicle. For example, apparatus 101 or 601 may be configured to mate with and attach to structural elements of an existing vehicle. Such a kit is encompassed by the scope of the present invention.

Figure 14A:
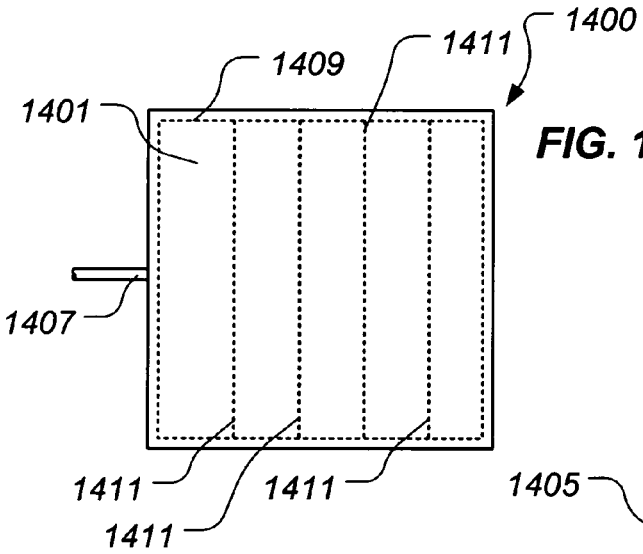
FIG. 14A is a top, plan view of a central portion preform according to the present invention.
Figure 14B:
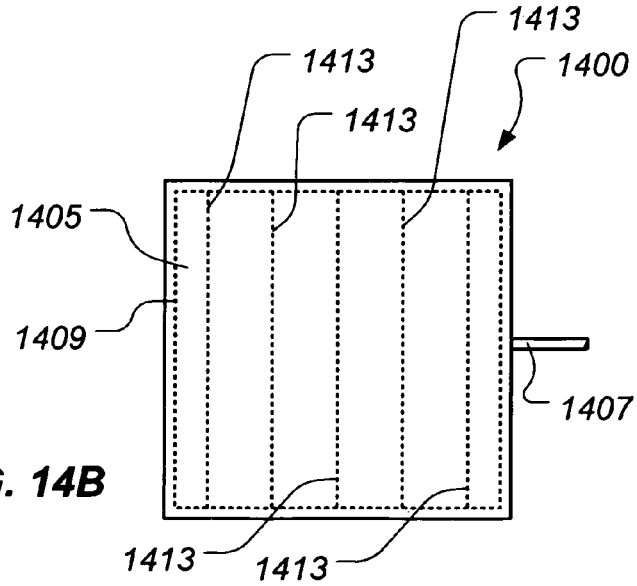
FIG. 14B is a bottom, plan view of the central portion preform of FIG. 14A.
Figure 15:
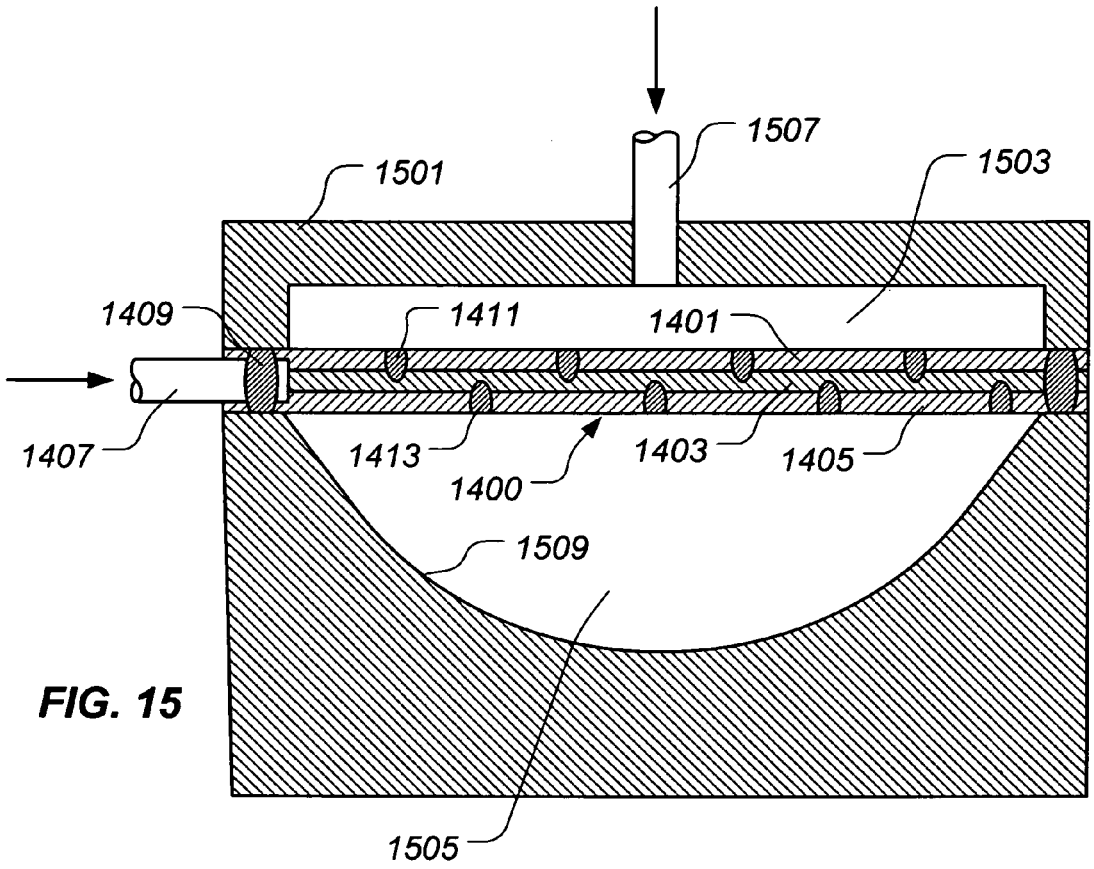
FIG. 15 is a cross-sectional view of the central portion preform of FIG. 14A and FIG. 14B disposed in a superplastic forming mold.

FIGS. 14A, 14B, and 15 depict one illustrative embodiment of a superplastic forming method of making one particular configuration of central portion 105 of either apparatus 101 or apparatus 601. FIG. 14A depicts a top, plan view and FIG. 14B provides a bottom, plan view, respectively, of a central portion preform 1400 prior to being formed. FIG. 15 provides a cross-sectional view of central portion preform 1400 disposed in a mold 1501. In this embodiment, central portion preform 1400 comprises three sheets 1401, 1403, and 1405 of superplastically-formable metallic material (e.g., certain titanium, aluminum, or steel alloys). A tube 1407 is inserted into sheets 1401, 1403, and 1405 such that tube 1407 is in fluid communication with spaces between sheets 1401, 1403, and 1405. Central portion preform 1400 further includes a peripheral weld or bond 1409 that seals central portion preform 1400 such that fluid (e.g., a gas) may enter or exit a volume within peripheral weld or bond 1409 via tube 1407.

Referring particularly to FIGS. 14A and 15, central portion preform 1400 further comprises a plurality of welds or bonds 1411 joining sheets 1401 and 1403. As shown in FIGS. 14B and 15, central portion also includes a plurality of welds or bonds 1413 joining sheets 1403 and 1405. Note that the plurality of welds or bonds 1411 is offset laterally from the plurality of welds or bonds 1413. Also, it should be noted that only one weld or bond 1411 and only one weld or bond 1413 are indicated in FIG. 15 for clarity. Welds or bonds 1411 and 1413 can be formed by a welding process (e.g., gas tungsten arc welding, laser welding, electron beam welding, or the like), by a diffusion bonding process, or another process capable of suitably joining sheets 1401, 1403, and 1405, as discussed above. Diffusion bonding involves holding components under a load at an elevated temperature, usually in a protective atmosphere or vacuum. The components are bonded via migration of atoms across the boundary between components. If diffusion bonding is used to generate the welds or bonds 1411, 1413, the overall process used to join sheets 1401, 1403, 1405 and form central portion preform 1400 into shape is known as superplastic forming/diffusion bonding (SPF/DB).

Referring now to FIG. 15, joined sheets 1401, 1403, 1405 are placed and retained in the mold 1501. Normally cavities 1503, 1505 are evacuated of air. Mold 1501 and central portion preform 1400 are heated to a temperature below the melting point of the material of which central portion preform 1400 is comprised. Preferably, mold 1501 and central portion preform 1400 are heated to about 80 percent of the melting temperature of the material of which central portion preform 1400 is comprised. Inert gas under pressure is slowly introduced through tube 1407 and through a tube 1507 extending into cavity 1503. The inert gas introduced through tube 1407 superplastically expands central portion preform 1400 and superplastically forms stiffening element 405 (shown in FIG. 4). Inert gas introduced through tube 1507 urges central portion preform 1400 toward inner wall 1509 of mold 1501. When central portion preform 1400 is suitably expanded and sheet 1405 is in suitable contact with inner wall 1509, forming is complete. The temperature of mold 1501 and central portion preform 1400 is reduced and inert gas pressure is relieved.

After removing formed central portion preform 1400 from mold 1501, central portion preform 1400 is trimmed to final shape, producing one particular embodiment of central portion 105. It should be noted that sheets 1401 and 1405 form inner skin 403 and outer skin 401 (both shown in FIG. 4), respectively, of central portion 105. Sheet 1403 forms stiffening element 405 (shown in FIG. 4). It should also be noted that sides 103*a*, 103*b* may be contiguous with outer skin 401, such that sides 103*a*, 103*b* are superplastically formed at the same time as outer skin 401. Moreover, other operations are required to produce apparatus 101 or 601. For example, sides 103*c*, 103*d* are welded or otherwise joined to central portion

105. Blast attenuator 701 is placed in cavity 605 prior to sides 103*c*, 103*d* being joined to central portion 105. Furthermore, if sides 103*a*, 103*b* are not formed at the same time as outer skin 401, sides 103*a*, 103*b* are welded or otherwise joined to central portion 105.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An apparatus for inhibiting effects of an explosive blast, comprising:

a central portion including a stiffening element and defining a radiused exterior surface;

a plurality of sides extending from the central portion for attachment to a structure;

first and second transverse member extending between the plurality of sides; and a blast attenuator, the blast attenuator comprising:

a core defining a plurality of interconnecting pores defining a pore volume of the core;

a shear thickening fluid disposed in the pore volume of the core; and an enclosure in which the core and the shear thickening fluid are disposed;

wherein the central portion and the plurality of sides are configured to redirect at least a portion of a blast wave resulting from an explosive blast; and wherein the first transverse member, the second transverse member, and the plurality of sides define a cavity in which the blast attenuator is disposed.

2. The apparatus, according to claim 1, wherein the central portion comprises:

an outer skin; and an inner skin;

wherein the stiffening element extends between the outer skin and the inner skin.

3. The apparatus, according to claim 2, wherein the stiffening element is a truss.

4. The apparatus, according to claim 1, further comprising:

a crushable portion disposed in the cavity.

5. The apparatus, according to claim 1, wherein the central portion is formed using a superplastic forming process.

6. The apparatus, according to claim 1, wherein at least some of the plurality of sides is configured to mate with a vehicle.

7. The apparatus, according to claim 1, wherein the apparatus forms a portion of a vehicle.

8. The apparatus, according to claim 1, wherein at least one of the plurality of sides forms an angle within a range of about 25 degrees to about 60 degrees with respect to a central axis bisecting the central portion.

9. The apparatus, according to claim 1, wherein the central portion exhibits a radius of at least about 15 centimeters.

10. The apparatus, according to claim 1, wherein the apparatus comprises a material exhibiting a modulus of elasticity greater than about ten million pounds per square inch.

11. The apparatus, according to claim 1, wherein the apparatus comprises one of aluminum, aluminum alloyed with one or more elements, titanium, titanium alloyed with one or more elements, and steel.

12. The apparatus, according to claim 1, wherein the apparatus comprises a material capable of being superplastically formed.

13. An apparatus for inhibiting effects of an explosive blast, comprising:

a central portion including a stiffening element and defining a radiused exterior surface;

a plurality of sides extending from the central portion for attachment to a structure;

first and second transverse members extending between the plurality of sides; and a blast attenuator;

wherein the central portion and the plurality of sides are configured to redirect at least a portion of a blast wave resulting from an explosive blast; and wherein the blast attenuator comprises:

a plurality of blast attenuation components, each blast attenuation component comprising:

a core defining a plurality of interconnecting pores defining a pore volume of the core;

a shear thickening fluid disposed in the pore volume of the core; and an enclosure in which the core and the shear thickening fluid are disposed.

14. The apparatus, according to claim 13, wherein the central portion comprises:

an outer skin; and an inner skin;

wherein the stiffening element extends between the outer skin and the inner skin.

15. The apparatus, according to claim 14, wherein the stiffening element is a truss.

16. The apparatus, according to claim 13, wherein the central portion is formed using a superplastic forming process.

17. The apparatus, according to claim 13, wherein at least some of the plurality of sides is configured to mate with a vehicle.

18. The apparatus, according to claim 13, wherein the apparatus forms a portion of a vehicle.

19. The apparatus, according to claim 13, wherein at least one of the plurality of sides forms an angle within a range of about 25 degrees to about 60 degrees with respect to a central axis bisecting the central portion.

20. The apparatus, according to claim 13, wherein the central portion exhibits a radius of at least about 15 centimeters.

21. The apparatus, according to claim 13, wherein the apparatus comprises a material exhibiting a modulus of elasticity greater than about ten million pounds per square inch.

22. The apparatus, according to claim 13, wherein the apparatus comprises one of aluminum, aluminum alloyed with one or more elements, titanium, titanium alloyed with one or more elements, and steel.

23. The apparatus, according to claim 13, wherein the apparatus comprises a material capable of being superplastically formed.

24. An apparatus for inhibiting effects of an explosive blast, comprising:

a central portion comprising:

an outer skin exhibiting a radius;

an inner skin; and a stiffening element extending between the outer skin and the inner skin;

a plurality of sides extending from the outer skin of the central portion;

a first transverse member extending between the plurality of sides;

a second transverse member extending between the plurality of sides, such that the first transverse member, the second transverse member, and the plurality of sides define a cavity; and a blast attenuator disposed in the cavity, the blast attenuator comprising:

a core defining a plurality of interconnecting pores defining a pore volume of the core;

a shear thickening fluid disposed in the pore volume of the core; and an enclosure in which the core and the shear thickening fluid are disposed.

25. The apparatus, according to claim 24, wherein at least one of the plurality of sides forms an angle within a range of about 25 degrees to about 60 degrees with respect to a central axis bisecting the central portion.

26. The apparatus, according to claim 24, wherein the outer skin of the central portion exhibits a radius of at least about 15 centimeters.

27. The apparatus, according to claim 24, further comprising:

a crushable portion disposed in the cavity.

* * * * *

UNITED STATES PATENT AND TRADEMARK OFFICE

CERTIFICATE OF CORRECTION

PATENT NO. : 7,631,589 B2
APPLICATION NO. : 11/414843
DATED : December 15, 2009
INVENTOR(S) : Hunn et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 676 days.

Signed and Sealed this

Second Day of November, 2010

David J. Kappos

David J. Kappos
*Director of the United States Patent and Trademark Office*